US005115605A

United States Patent [19]

Butler

[11] Patent Number: 5,115,605

[45] Date of Patent: May 26, 1992

[54] WINDOW UNIT

[75] Inventor: Dennis Butler, Georgetown, Pa.

[73] Assignee: Glenn Technologies, Inc., Cecil, Pa.

[21] Appl. No.: 480,740

[22] Filed: Feb. 16, 1990

[51] Int. Cl.[5] ..... E06B 1/04; E04F 19/02

[52] U.S. Cl. ..... 52/105; 52/204; 52/211

[58] Field of Search ..... 52/204, 210, 211, 212, 52/57, 105; 45/504

[56] References Cited

U.S. PATENT DOCUMENTS

| | | | |
|---|---|---|---|
| 2,303,739 | 12/1942 | Hasenburger | 52/11 |
| 2,944,305 | 7/1960 | Avery | 52/212 |
| 3,156,022 | 11/1964 | Schlegel | 52/211 |
| 3,694,961 | 10/1972 | Johnson | 49/504 |
| 3,869,840 | 3/1975 | Hoffmann | 52/211 |
| 4,642,955 | 2/1987 | Webb | 49/504 |
| 4,768,316 | 9/1988 | Haas | 52/204 |
| 4,780,998 | 11/1988 | Knapp | 52/211 |

FOREIGN PATENT DOCUMENTS

| | | | |
|---|---|---|---|
| 1080234 | 12/1954 | France | 52/211 |

*Primary Examiner*—John E. Murtagh

[57] ABSTRACT

A unitary framing assembly for use in framing an aperture in a wall or a roof, ordinarily a window aperture, has important features which enable its easy installation and yet which provide a superior weather seal. These features include the rout in the outer edge of the molding of the window unit, an intrinsically L-shaped or F-shaped polymeric preformed weather/nailing flange (preferably molded or vacuum formed) which is positioned within or adjacent said rout, prelocated nail marks, centering lines on the uppermost surface of the jamb for centering the window unit during installation, and associated interior trim pieces with incorporated stop structures.

2 Claims, 4 Drawing Sheets

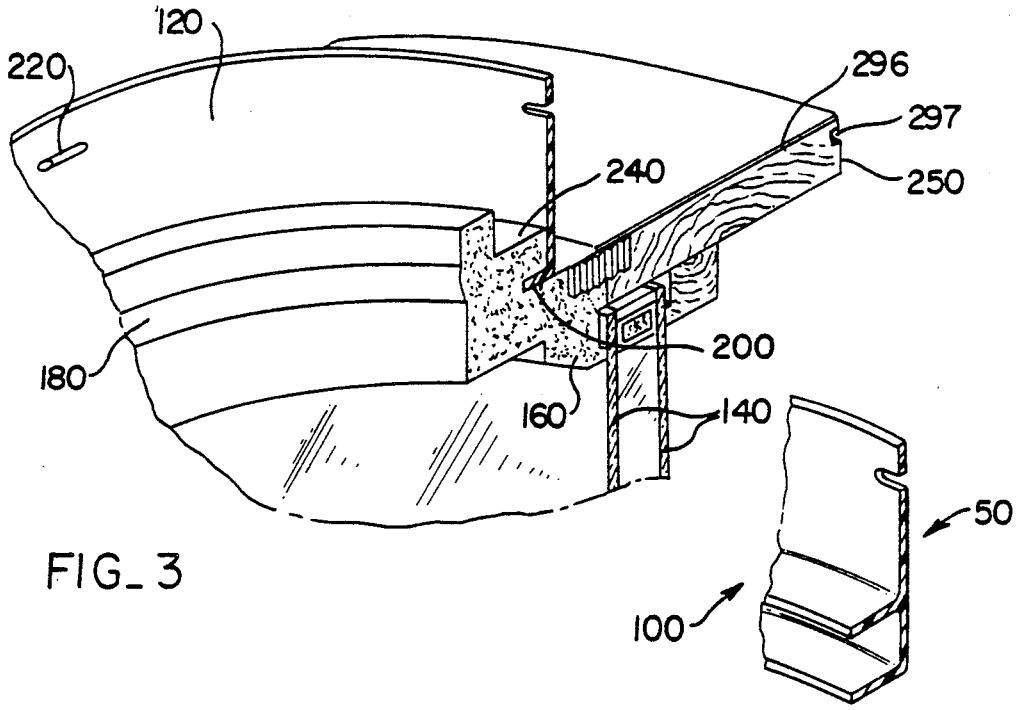
FIG_3
FIG. 3A
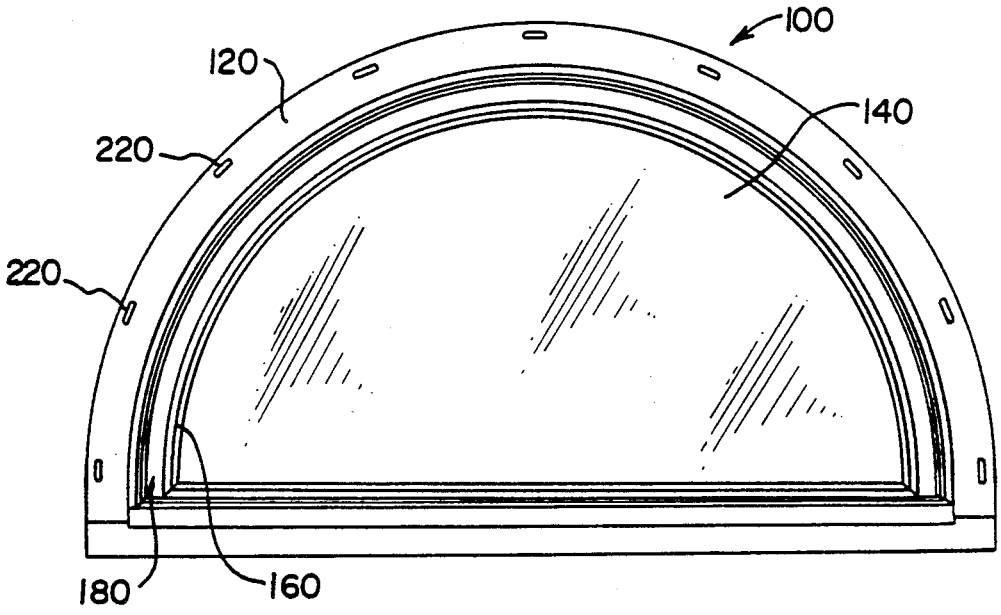
FIG. 4

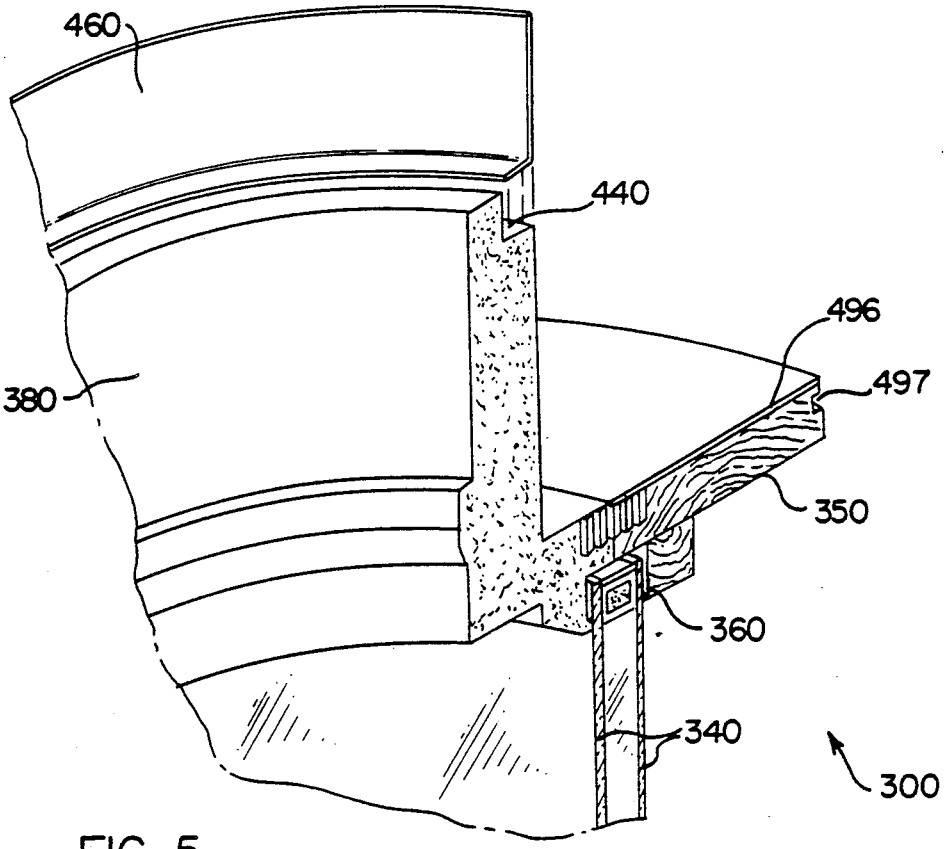
FIG. 5
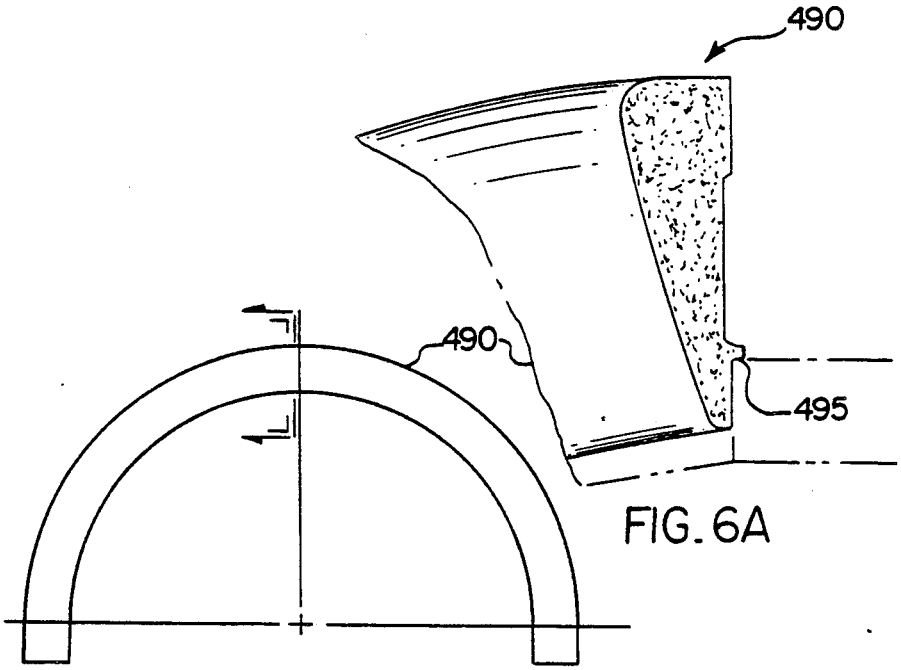
FIG. 6A
FIG. 6

WINDOW UNIT

FIELD OF THE INVENTION

The present invention is directed to unitary windows which are fast and easy to install yet provide superior appearance, insulation and weather seal.

BACKGROUND OF THE INVENTION

Detailing of architectural constructs has traditionally been several times more labor-intensive than completion of the basic structure. For example, the fitting of a louver or vent, window or door in an aperture in a building wall or roof has heretofore required several steps, including constructing the sash (or louver or vent), constructing the frame, adapting insulating materials and/or weather fins to the shape of the aperture, and securing all structures in the appropriate relative positions.

When apertures having curved edges—such as are designed to receive half—round windows—were finished according to the prior art, even greater finishing efforts were required than for straight-edged architectural features. Not only were half-round and other curved windows and doors difficult to design and to build in place, but the required weatherproofing materials were not easily adapted from their intrinsically straight configurations to the curved window or door surfaces. For example, the J-channel flashing well known in the building arts as a flashing on the sides and headers of masonry-veneer wood frame exterior wall openings is simply not adaptable to bending around a curved surface without concomitant rippling and distortion. The rippling and distortion tendencies not only take additional time on the part of the craftsman or builder, but ultimately do not permit the weather-tight construction for which the materials are used in the first place. In other words, carpentry finishing of any wall or roof aperture is time consuming, and in the case of curved or round apertures the best hand carpentry may still fall short of the ideal. A need therefore remains for a window unit which meets all of the aesthetic and mechanical requirements for finished apertures in walls or roofs and yet which can be installed with a minimum of time and labor.

SUMMARY OF THE INVENTION

In order to meet this need, the present invention is a unitary framing assembly for use in framing an aperture in a wall or a roof. Ordinarily, this unitary framing assembly is a window unit. The window unit contains important features which enable its easy installation in an aperture and yet which provide a superior weather seal compared to known construction techniques including window prefabrication These features include the rout in the outer inside edge of the molding of the window unit, an intrinsically L-shaped or F-shaped polymeric preformed weather/nailing flange, preferably molded or vacuum formed, which is positioned within or adjacent said rout, prelocated nail marks, centering lines on the uppermost surface of the jamb for centering the window unit during installation, and associated interior trim pieces with incorporated stop structures. Most preferably, the vacuum formed heavy duty L-shaped or F-shaped weather/nailing flange is constructed of 0.025–0.046 inch thick UV resistant polymer such as acrylonitrile butadiene styrene or equally weather resistant materials.

BRIEF DESCRIPTION OF THE DRAWINGS

FIG. 3 is a detail of the present weather/nailing flange as it is incorporated within the molding and the associated an alternate embodiment of the present window unit;

FIG. 3A illustrates an alternate embodiment of the present weather/nailing flange;

FIG. 4 illustrates the laternate embodiment of the window unit of FIG. 3 as viewed from the front;

FIG. 5 illustrates a third embodiment of the present window unit;

Figure 7:
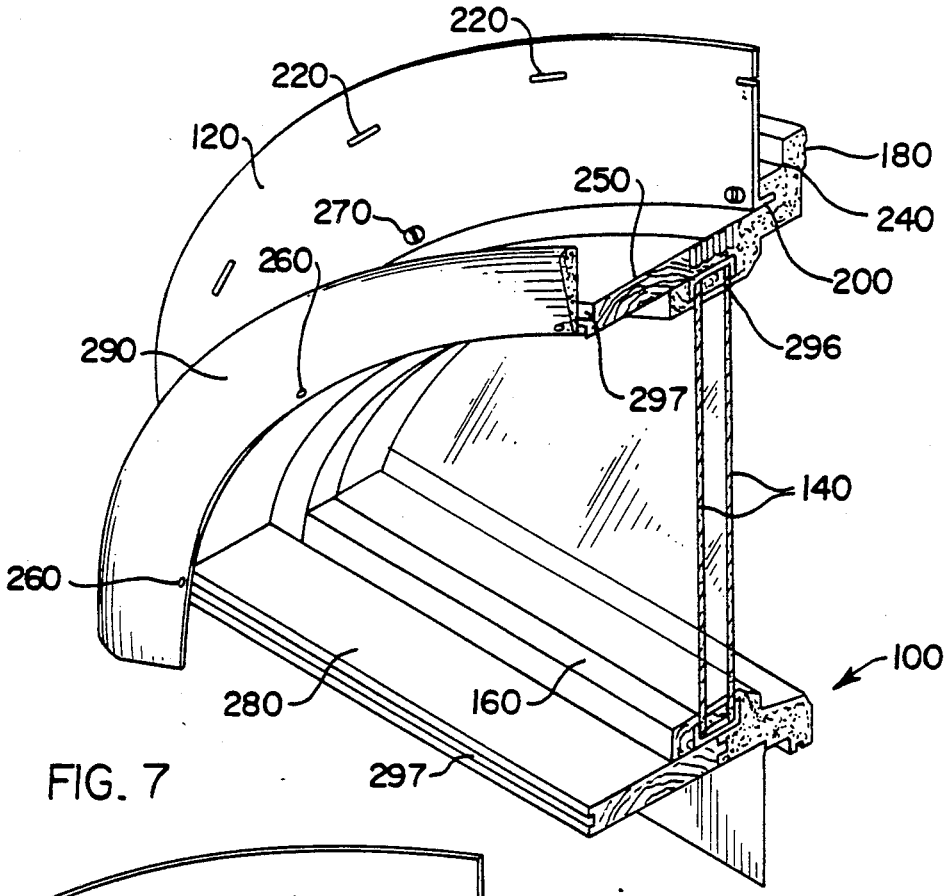
Figure 8:
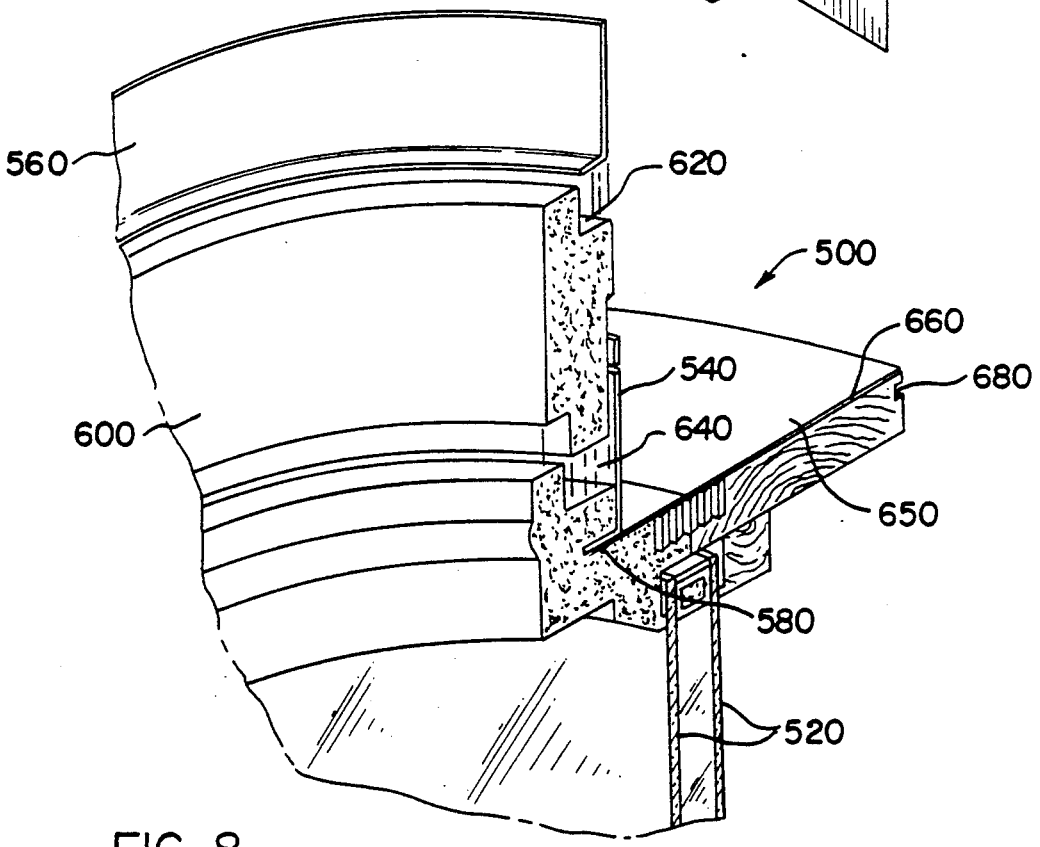

FIG. **6–6*a* is a rear elevational view of an interior trim piece adapted for engagement with the window unit of FIG. 5**;

FIG. 7 is a rear perspective view of the alternate embodiment of the window unit as shown in FIGS. 3 and 4, which has been fitted with an interior trim piece; and FIG. 8 illustrates a fourth embodiment of the present window unit, which fourth embodiment incorporates two weather flanges.

DETAILED DESCRIPTION OF THE INVENTION

Figure 1:
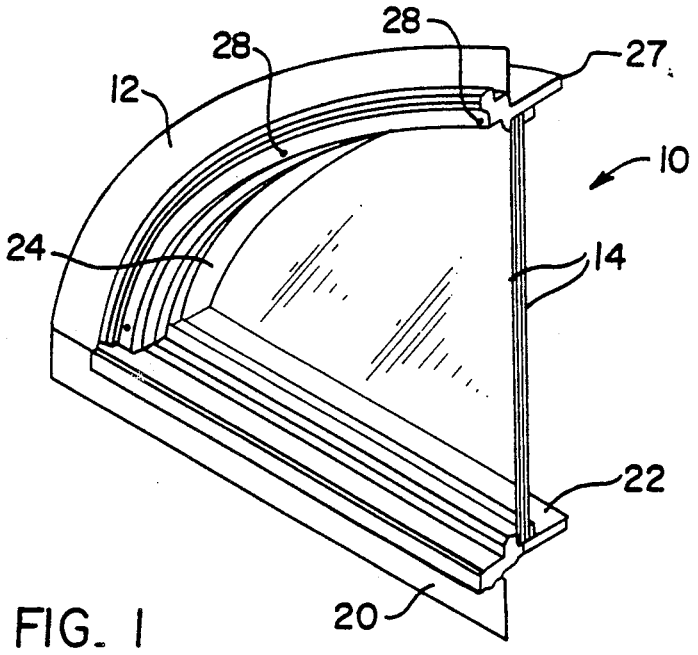
FIG. 1 is a perspective view of a section of a half-round of the present window unit.

Referring now to FIG. 1, a half-round window of a style known in the art is shown in perspective and in vertical section at its horizontal center. The window unit 10 includes the weather/nailing flange 12, insulated glazing 14, undersill fin 20, sill 22, and jamb 24. A prelocated centermark 27 intersects the uppermost surface of the jamb 24. The molding 18 as shown is molded polyurethane resin, finished to look like wood.

Figure 2:
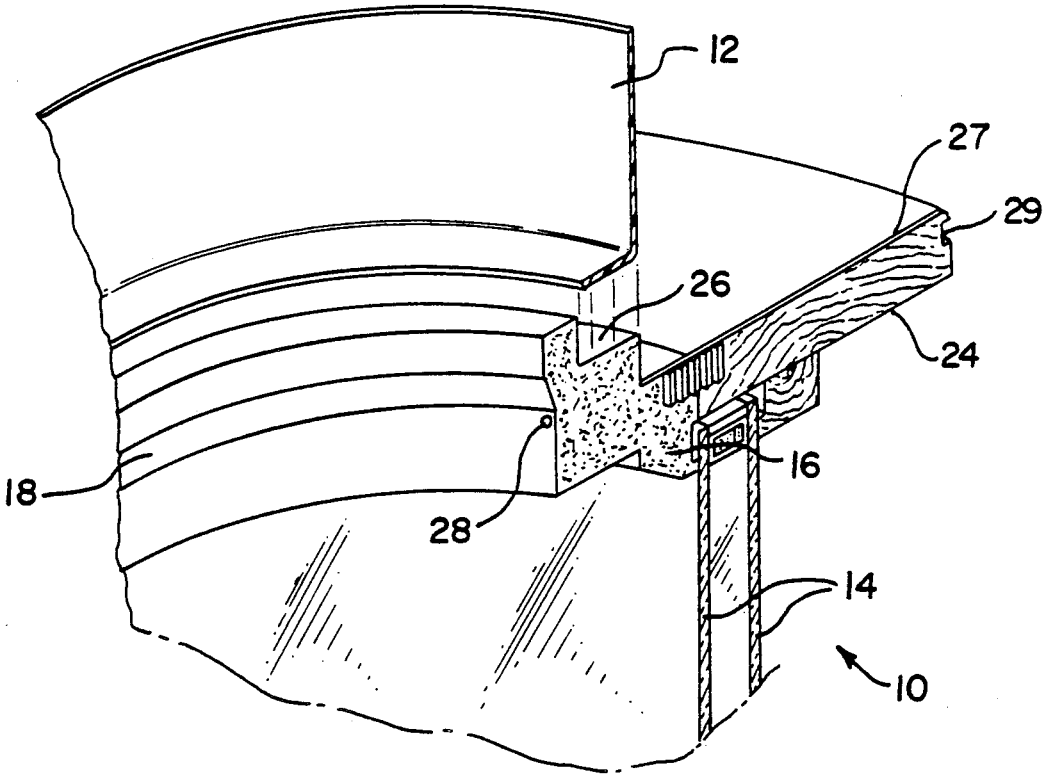
FIG. 2 is an enlargement of a segment of the upper portion of the window unit of FIG. 1, partially exploded.

The uppermost portion of FIG. 1 is shown in enlargement in FIG. 2, important because an essential feature of the present invention is not visible in FIG. 1. The molding 18 contains a siding rout 26. The siding rout 26 is a stepped-down L-shaped recess all along the uppermost surface of the molding 18, on the inside or glazing side. The L-shaped recess is therefore open on two sides. This recess, or siding rout 26, provides a premeasured lip into which siding may be inserted subsequent to installation of the present window unit. (The window may also be used with exterior wall materials other than siding—in masonry structural walls, for example. The present weather/nailing flange need only be positioned interior to a brick or masonry structural wall, for example, or in some instances can be removed completely. Masonry walls can easily be sculpted to receive the present window unit.)

The siding rout 26 is contacted, along its lower most surface, with the lower portion of the L-shaped weather/nailing flange 12. Although for illustration the weather/nailing flange 12 has been exploded from the molding 18 in FIG. 2, in combination the weather/nailing flange 12 and the siding rout 26 are tightly secured (watertight seal) with staples, nails, screws or other mechanical fasteners, polymeric bonding agents or a combination of these.

The vertical portion of the weather/nailing flange 12 is characterized by its structure and the materials which form it. That is, the weather/nailing flange 12, which is constructed of a material which is both pliable and watertight, is manufactured of a material and in a gauge which enables the vertical portion of the weather/nailing flange 12 to remain vertical without exterior support.

Referring once again to FIG. 1, the undersill fin 20 of the window unit is a structure known in the art; floppy, watertight materials for sealing the gap between windows and structural walls are known. Only one skilled in the art readily appreciates, however, that this floppy material typically used for undersill fins cannot likewise be used on upper surfaces of windows, due to the effects of gravity. If the same material which constitutes the undersill fin 20 were attached to the present molding 18, an extensive plurality of fasteners would be required to secure the floppy material in an upright position against the structural wall. Instead, the vertical portion of the present weather/nailing flange 12 is both pliable yet free-standing, so as to ease installation and also to provide a weather barrier with longevity.

The jamb 24 is of wood construction and the jamb 24 and the molding 18 are secured together by means known in the art. Jutting portions of each of the molding 18 and jamb 24 form the sash 16, which sash is typical of prior art sashes for insulated glazing in windows. The jamb 24 incorporates a jamb extension groove 29, which groove is adapted to receive the cooperating protrusion of an additional jamb extension (known in the art and shown in dotted configuration in FIG. 2). An interior trim piece is added after the window unit is positioned in the structural wall opening. Such trim piece is located by protrusions as shown in FIG. 6A.

Referring once again to FIG. 1, the nail marks 28 appear on the molding 18 at horizontal and at 45° and 90° from the horizontal. These nail marks identify the only places on the window which can be nailed to the studs underlying a half-round window, which studs are positioned by means known in the art.

Referring now to FIG. 3, an alternate embodiment of the window unit is illustrated in sectioned perspective. The window unit 100 incorporates the insulated glazing 140, the sash 160, the molding 180 and the jam 250. In this alternate embodiment of the window unit, the weather/nailing flange 120 is affixed within the flange recess 200; the bottom leg of the L-shaped weather/nailing flange 120 fits within and is secured into the flange recess 200 by fastening means such as a polymeric bonding agent and/or suitable mechanical fasteners. An advantage of the configuration of the alternate embodiment is that, upon installation, the molding 180 holds the adjacent upright portion of the weather/nailing flange 120 in firm abutment to the adjacent wall, for a secure seal.

FIG. 3A illustrates a variation on the alternate weather/nailing flange 120 of FIG. 3. This alternate configuration 50 is not merely L-shaped but is upside-down F-shaped, and the two horizontal protrusions of the alternate configuration 50 are used by bonding them within two spaced flange recesses within the window molding instead of the single flange recess 200 of FIG. 3. The alternate configuration 50 of FIG. 3A functions in the same way as does the weather/nailing flange 120 of FIG. 3, and the double-fastened structure predominately provides enhanced stability to the construction of the window as a whole.

Each of FIGS. 3 and 4 illustrates a weather/nailing flange 120 having nail apertures 220 therein. Although the nail apertures 220 are not strictly necessary—nails will perforate the weather/nailing flange—the nail apertures 220 provide convenience to the carpenter by way of providing prefabricated nail placement direction and also three dimensional nail guides.

Referring now to FIG. 5, a third embodiment of the present window is illustrated. The window unit 300 includes insulated glazing 340, the jamb 350 having the jamb extension groove 497, the sash 360, the siding rout 440 and the weather flange 460. The weather flange 460 is identical to the weather/nailing flange 12 of FIG. 1, but it is placed upon an exterior trim 380 which forms a part of the unitary window instead of the narrower molding 18 of FIG. 1. FIG. 5 illustrates the way in which the weather flange and siding rout of the present invention can be adapted to a variety of styles of unitary windows as are already known in the art.

The jamb extension groove 497, which appears on the upright flat surface of the jamb 496 at the far indoor edge, is a groove into which is adapted to fit a cooperating stop of a jamb extension. After the window unit of FIG. 5 is placed within the rough opening in the structural wall, and siding (if appropriate) is positioned on the exterior of that wall and the interior is finished according to means known in the art (dry wall or plaster, etc.), interior trim 490 is positioned (nailed or otherwise fastened) with the trim stop 495 in abutment to the jamb extension to finish the window interior. Although the interior trim 490 is shown as an arcuate strip having the usual window molding attributes together with the trim stop 495, the interior trim may take any shape so as to conform with unitary windows of varying shape. Ordinarily, the trim stop 495 and the jamb extension groove 497 are three sided rectangular protrusions/indentations with thickness and protrusion dimensions of between one eighth and one-quarter inch. The trim stop 495 rests atop the upper edge of either the jamb or the jamb extension.

Referring once again to FIG. 5, a pre-located centermark is provided to the upper surface of the jamb 350 to enable the carpenter to assure centered placement of the window unit 300. The prelocated centermark may take the form of a shallow rout in the upper surface of the jamb, or other means of marking including inks, paints or polymers may be used.

Referring now to FIG. 7, the window unit illustrated in FIGS. 3 and 4 is shown in reverse, that is, the sectioned perspective view of FIG. 7 shows the window unit from the indoor sill side. All of the features of the window unit of FIG. 7 are the same as shown in FIGS. 3 and 4, therefore, except that certain features of the invention are visible only in FIG. 7. For example, optional support screws 270 hold the weather/nailing flange 120 in firm adhesion to the molding 180; these support screws 270 may be used in addition to a polymeric binder within the flange recess 200, may be used alone, or the polymeric binder may be used alone. Spaced-apart nail marks 260 are provided on the interior trim 290 to facilitate adjoining of the interior trim 290 to the jamb 250. The sill 280 is readily visible in this interior view.

Referring now to FIG. 8, the window unit 500 incorporates one weather flange 560 and one weather/nailing flange 540 as an illustration of the versatility of the present invention. The weather/nailing flange 540 is affixed within the weather flange recess 580 within the molding 510. The weather flange 560 is designed to be bonded to the exterior trim 600, which forms a cooperating add-on and is designed to mate to the molding 510 which exterior trim 600 fits and bonds or affixes cooperatively within the molding rout 640. The weather flange 560 is bonded and/or mechanically fastened to the exterior trim rout 620, and the assembled window unit of FIG. 8 thus contains two weather flanges. In like manner as FIG. 7, FIG. 8 illustrates the jamb 650 having the jamb extension groove 680, the insulated glazing 520, and the prelocated centermark 660 on the upper surface of the jamb 650.

Although the present Figures illustrate pertinent portions of half-round windows, the present window unit and its incorporated features may be adapted to any shape. Accordingly, the window unit may be square, rectangular, hexagonal, octagonal, oval or elliptical, half-oval or half-elliptical, or any other shape desired. The positioning of the nail marks 28 at horizontal, 45° and 90° angles from the horizontal is a feature of the half-round window only. Other window shapes will have nail marks corresponding to the framing structure. The window shapes which do not have horizontal straight lower surfaces are fitted with preformed weather flanges instead of the undersill fin shown in the Figures. For a full round window, therefore, the siding rout and weather flange will both completely encircle the window molding and will provide the entire weather seal.

For stability, the present weather flange is preferably vacuum-formed of a stiff-yet-flexible UV-resistant polymer. Generally, the suitable polymers include the styrene-butadiene polymers, polyvinyl polymers, polyurethane polymers and low-density polyethylene polymers. Most polyacrylate polymers are not suitable for use for construction of the present weather flange because they yield excessively rigid sheet material which does not give a good weather seal. The selected polymer must be deformable but must be able to form a self-supporting upright sheet of at least two inches. The weather/nailing flange should be between about 0.02 and 0.05 inches in thickness, more preferably between about 0.025 and 0.046 inches in thickness, and most preferably 0.040 inches thick.

Preferably, the weather/nailing flange of the present invention is molded, more preferably vacuum formed, not only in its L- or F-shaped configuration but also in the overall configuration (curve, square, etc.) of the window to which it will be affixed. Molding or vacuum forming of the flange provides the best possible weather seal.

Although the invention has been described with particularity above, with reference to particular shapes, structures and materials, the invention is to be limited only insofar as is set forth in the accompanying claims.

I claim:

1. In a unitary framing assembly having a jamb and associated molding which together constitute a window unit having glazing and a sash, the improvement comprising a rout within said molding, said rout being positioned on the outer edge of said molding on the side of said molding adjacent said jamb, further wherein said rout has a weather/nailing flange associated therewith, further wherein said weather/nailing flange is L-shaped and further wherein said L-shaped weathr/nailing flange is bonded to said rout by means of both staples and a polymeric bonding agent, said rout further comprising a stepped down aperture in said molding wherein said aperture is open on two sides, said aperture further having dimensions adequate to receive exterior building materials therein adjacent to said molding.

2. In a unitary framing assembly havign a jamb and associated molding which together constitute a window unit having a glazing and a sahs, the improvement comprising a rout within said molding, said rout beign positioned on the outer edge of said molding on the side of said molding adjacent said jamb, said rout having a weather/ nailing flange associated therewith, and further wherein said jamb has an upper surface thereon and said upper surface bears a centermark, said rout further comprising a stepped down aperture in said molding wherein said aperture is open on two sides, said aperture further havign dimensions adequate to receive exterior building material therein adjacent to said molding.

* * * * *

UNITED STATES PATENT AND TRADEMARK OFFICE

CERTIFICATE OF CORRECTION

PATENT NO. : 5,115,605

DATED : May 26, 1992

INVENTOR(S) : Dennis Butler

It is certified that error appears in the above-identified patent and that said Letters Patent is hereby corrected as shown below:

Cover page, under "Primary Examiner-John E. Murtagh" insert --Attorney, Agent, or Firm-Webb, Burden, Ziesenheim & Webb, P.C.--.

Column 1 Line 57 after "prefabrication" insert --.--.

Column 2 Lines 5-6 after "half-round" insert --embodiment--.

Column 2 Line 12 after "associated" insert --sash of--.

Column 2 Line 16 "laternate" should read --alternate--.

Claim 1 Line 23 Column 6 "weathr" should read --weather--.

Claim 2 Line 30 Column 6 "havign" should read --having--.

Claim 2 Line 32 Column 6 "sahs" should read --sash--.

Claim 2 Line 33 Column 6 "beign" should read --being--.

UNITED STATES PATENT AND TRADEMARK OFFICE

CERTIFICATE OF CORRECTION

PATENT NO. : 5,115,605

DATED : May 26, 1992

INVENTOR(S) : Dennis Butler

It is certified that error appears in the above-identified patent and that said Letters Patent is hereby corrected as shown below:

Claim 2 Line 36 Column 6 "weather/ nailing" should read --weather/nailing--.

Claim 2 Line 41 Column 6 "havign" should read --having--.

Claim 2 Line 42 Column 6 "material" should read --materials--.

Signed and Sealed this

Seventeenth Day of August, 1993

Bruce Lehman

*Attest:*

BRUCE LEHMAN

*Attesting Officer*

*Commissioner of Patents and Trademarks*